United States Patent [19]

Coleman et al.

[11] 3,944,762

[45] Mar. 16, 1976

[54] KEY-OPERATED SWITCHES

[75] Inventors: Arthur Coleman; Andrew Swan, both of Dundee; David Doig, Monifieth, all of Scotland

[73] Assignee: Veeder Industries, Inc., Hartford, Conn.

[22] Filed: Sept. 11, 1974

[21] Appl. No.: 505,157

[30] Foreign Application Priority Data

Sept. 18, 1973 United Kingdom ..... 43685/73

[52] U.S. Cl. ..... 200/44; 335/206; 335/207; 340/274 C

[51] Int. Cl.[2] ..... H01H 9/00

[58] Field of Search ..... 335/205, 206, 207; 340/274 R, 274 C; 200/42, 44, 45

[56] References Cited

UNITED STATES PATENTS 2,769,873 11/1956 Noregaard ..... 340/274 C

*Primary Examiner*—Herman Hohauser

*Attorney, Agent, or Firm*—Prutzman, Hayes, Kalb & Chilton

[57] ABSTRACT

A key operated switch device in which any one of a set of different keys may be utilized to operate a particular combination of sets of electrical contacts unique to that key, the sets of electrical contacts being provided by reed switches located adjacent a keyway adapted to receive any one of the keys in said set, and the keys incorporating different arrangements of magnets or magnetized zones adapted to actuate different combinations of said reed switches.

9 Claims, 8 Drawing Figures

KEY-OPERATED SWITCHES

BRIEF SUMMARY OF THE INVENTION

This invention relates to key operated switches of the type in which any one of a plurality of different keys may be utilized to control a common function, but the use of any particular key causes the operation of a particular combination of sets of electrical contacts, which can be utilized to record the identity of a key used or to enable different counters to meter or record the common function according to the key used. The common function in an exemplary case would be operation of a fuel dispensing unit, and the amount of fuel dispensed during any one operation of the unit would be recorded on any one of a number of counters according to which of a corresponding number of different keys was utilized.

Examples of such key operated switches are described in British Patent Specification No. 1,317,436, and it will be noted that in order to provide the functions required, a rather large number of tumbler pins are required in a lock of fairly complex construction. Although an improvement on previous locks of this type, there is always the possibility of tumbler pins sticking in any lock mechanism which depends on spring loading to return the pins, and while sticking tumbler pins will merely degrade the security performance of a security lock mechanism, they will completely disrupt a coding function as described above. The slightest possibility of failure must thus be as far as possible eliminated.

The object of the invention is to provide a key operated switch of the type described above in which mechanically operated tumbler or tumbler pins are eliminated, at least for the coding function.

According to the invention, a key operated switch device has a set of different keys any one of which may be utilized to control a common function, the use of any particular key causing the operation of a particular combination of sets of electrical contacts in the switch device unique to that key, wherein the sets of electrical contacts are provided by reed switches located adjacent a keyway adapted to receive any one of the keys in said set, and the keys incorporate different arrangements of magnets or magnetized zones adapted to actuate different combinations of said reed switches. The common function is preferably also controlled by a circuit including a reed switch or switches located adjacent said keyway, and the keys incorporate a common arrangement of one or more magnets or magnetized zones adapted to actuate said switch or switches. Preferably also an additional reed switch is located adjacent the keyway, the keys not incorporating any magnets or magnetized zones adapted to actuate this switch, the purpose of which is to detect attempts to actuate the device with magnets other than authorized keys. The additional reed switch is preferably arranged so as to disable the common function when actuated.

Other objects will be in part obvious and in part pointed out more in detail hereinafter.

A better understanding of the invention will be obtained from the following detailed description and the accompanying drawings of illustrative applications of the invention.

DESCRIPTION OF THE PREFERRED EMBODIMENT

Figure 1:
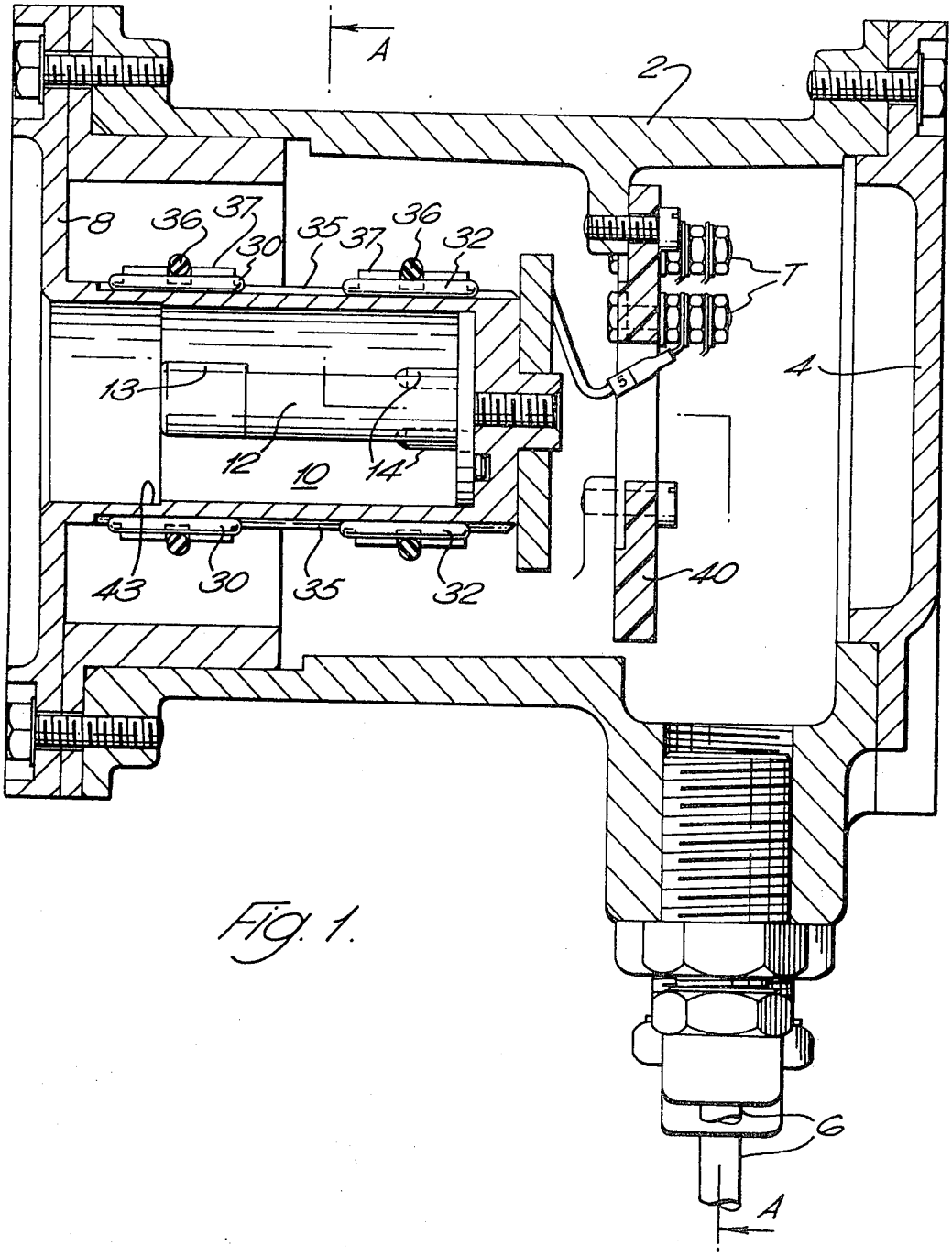
FIG. 1 is a longitudinal cross section through a key operated switch in accordance with the invention, on the line B—B in FIG. 2.
Figure 2:
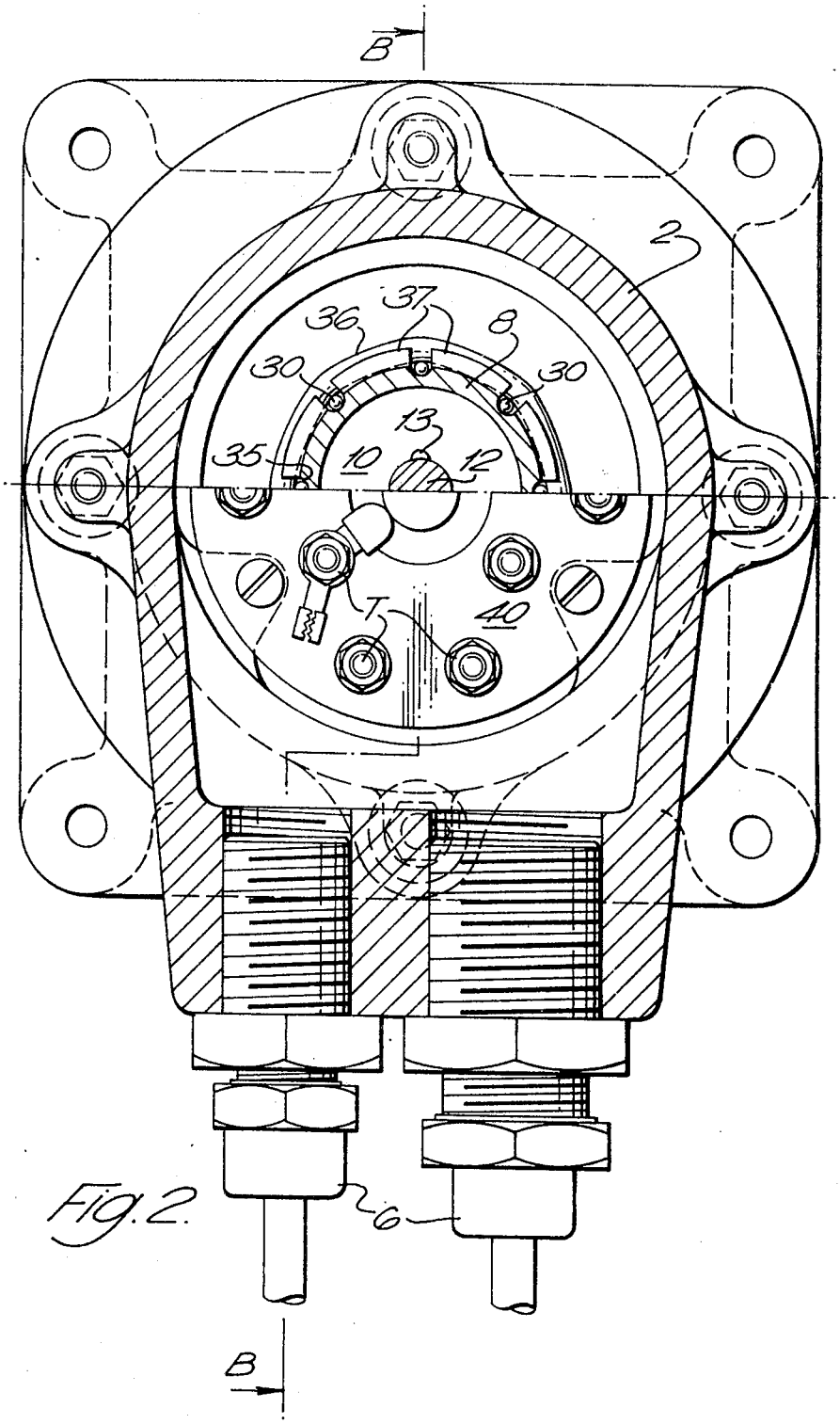
FIG. 2 is a cross section through the switch on the line A—A in FIG. 1.
Figure 3C:
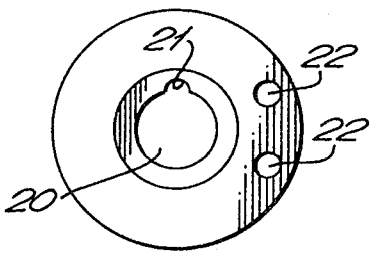
FIGS. 3A, 3B, 3C, 3D and 3E are end, side, and longitudinal and transverse opposite end sectional views of a key.
Figure 3B:
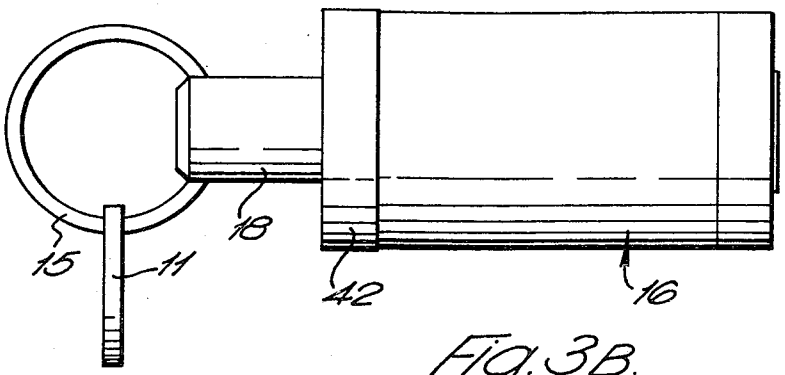
Figure 3A:
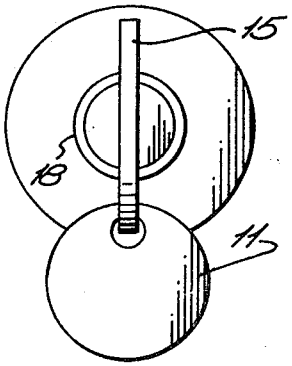
Figure 3E:
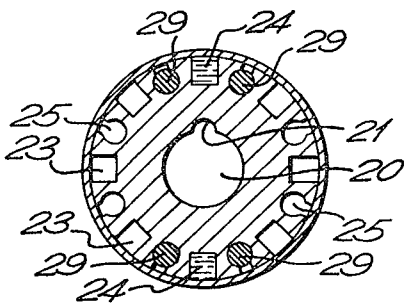
Figure 3D:
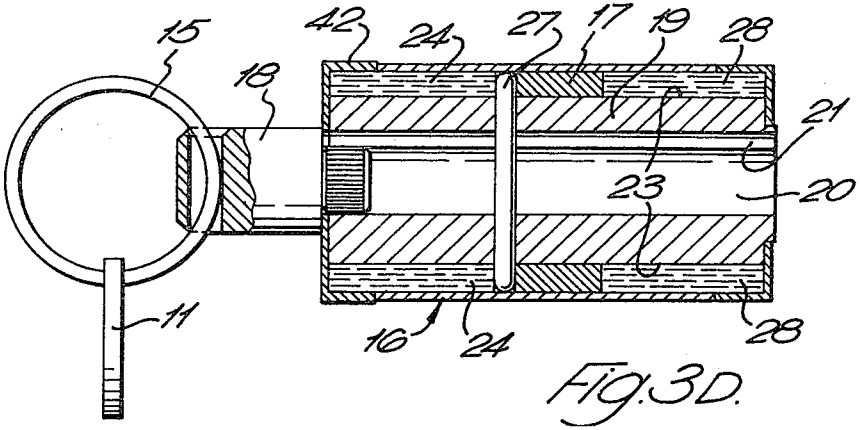

Referring to the drawings, a key operated switch comprises an outer housing 2, having a detachable rear access plate 4 and cable inlets 6, and an inner tubular housing 8 which defines a cylindrical keyway 10 and cooperates with the outer housing to form a flameproof enclosure constructed in accordance with conventional practice for such enclosures. Flameproofing of the device will only be necessary in certain environments such as pumps dispensing inflammable fuel, and in many cases the outer housing may be of less complex construction or even dispensed with.

The inner housing carries a guide post 12 projecting along the axis of the keyway, and at least one (two in the example shown) security pin 14 also projecting parallel to the post 12 from the bottom of the keyway. A number of externally identical keys (apart from any deliberately applied identification or code) are provided, each comprising a cylindrical body 16, having a projection 18 at one end with a ring handle 15 to enable the key to be gripped and an identification tag 11, and a central bore 20 adapted to receive the guide post 12. The body 16 is a sliding fit within the keyway 10, and is formed at its other end with an opening or openings 22 adapted to receive the security pin or pins so that the key may enter the keyway fully, and is located in a definite angular relationship to the keyway: the post 12 is formed with a spigot 13 which engages a groove 21 in the wall of the bore 20 to aid correct location of the key as it is inserted. The body 16 comprises a non-ferrous outer cover 17 enclosing a core 19 also of non-ferrous material and formed around its periphery with a plurality of axially extending slots 23 alternating with keyhole slots 25. An 0-ring 27 engaged in a groove surrounding the core divides the slots 23 and 25 longitudinally and permanent magnet pins 24 are inserted into the handle end of selected slots 23. Soft iron screening rods 29 are inserted into the keyhole slots 25 on either side of each magnet pin 24. Each key is provided with a different arrangement of magnet pins 24, 256 different combinations being available if arrangements in which all or none of the slots 23 are fitted with magnets are included.

At the other end of each key, magnet pins 28 are similarly inserted into the axial slots 23. All the keys carry the same arrangement of magnets 28, which are typically two in number. The slots 25 accommodate the security pin or pins when they enter the opening or openings 22.

Figure 4:
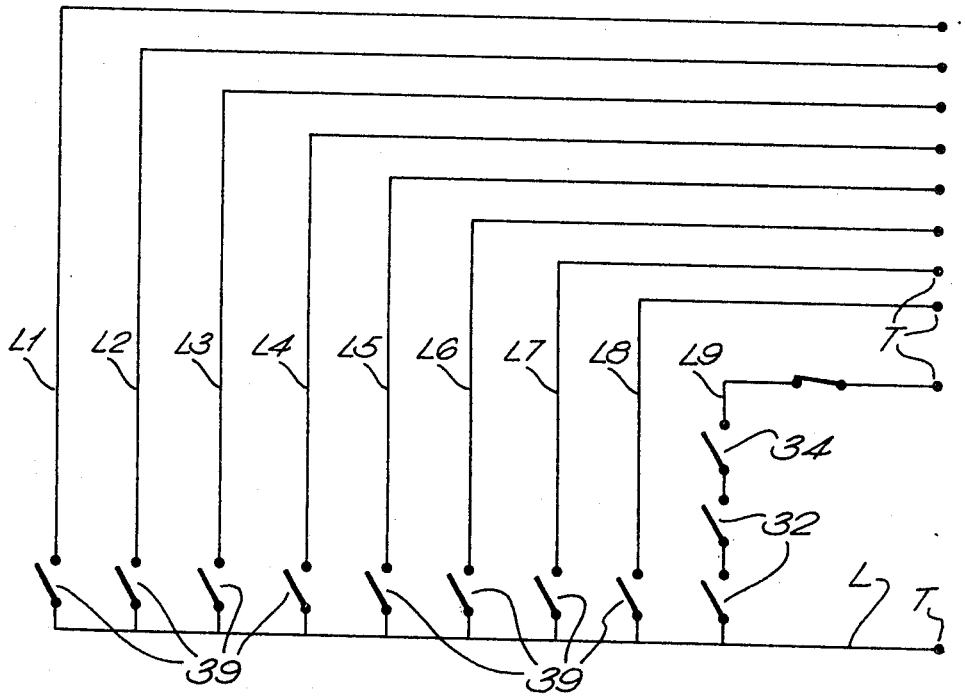
FIG. 4 is a circuit diagram of the switch device.

At least the inner housing 8 is of non-ferrous metal, and a number of reed switches 30, 32 and, optionally, an additional reed switch 34 schematically shown in FIG. 4 are mounted in an annular arrangement around the external surface of that portion of the housing which defines the keyway. The surface of the housing may be formed with axially extending grooves 35 and projections 37 to assist in locating the reed switches, which are secured in place by retaining rings 36. A first ring of eight switches 30 is arranged so that when a key is fully inserted in the keyway 10, they lie adjacent those parts of the slots 23 accommodating the magnets 24, while the two switches 32 and the optional switch 34 are arranged in a second ring so that the two switches 32 will lie adjacent the magnets 28 of a fully inserted key. The positioning of the optional switch 34 is non-critical, except that it must not lie close to any of the magnets 24, 28 of an inserted key. In the embodiment shown, the switches 30 the two switches and 32 are normally open and the optional switch 34 is normally closed. It may be necessary to provide the reed switches with thin metal screens so as to provide partial magnetic screening and thus prevent spurious operation by stray magnetic fields, while reliable operation is also assisted by the screening rods 29.

The switches are connected to a common supply line L in the manner shown in FIG. 4, the two switches 32 and the optional switch 34 being in series, and controlling a common output line L9, while the switches 39 each control one of eight independent output lines L1–L8. The lines L and L1–L9 are taken to terminals T on a terminal board 40 within the housing 2. Connections are made to the terminal board via the inlets 6.

When a key is fully inserted in the keyway, its magnets 28 will cause the switches 32 to close, thus completing a circuit controlling the function which the key operated switch device is intended to control. The number of magnets 28 and switches 32 employed may be chosen according to the degree of security required. At the same time, those of the pins 24 which are magnets will close the switches 30 to which they lie adjacent in a combination unique to that key and by detecting which output lines are energized, the identity of the key used may be recorded, or, for example, a particular counter rendered operative to receive the output of a meter associated with a fuel pump controlled by the key operated switch device. If an attempt is made to operate the switch device without a key by inserting a magnet in the keyway 10, then the switch 34, if used, will open and break the circuit to the device controlled. A further degree of security is obtained by providing the keys with a raised annular band 42 which enters a mating rebate 43 at the entrance of the keyway 10 when the key is fully inserted. This prevents any possibility of interference with the function of the reed switches by inserting a thin steel blade, such as a feeder gauge blade, between the key and the wall of the keyway.

The only moving parts in the device are the reeds 39 of the switches 30, 32 and 34, and these devices are hermetically sealed and well known for their long life and reliable operation. All tumblers and tumbler pins are eliminated, and the mechanical construction of the device is greatly simplified. The absence of moving parts requiring external access greatly simplifies flameproofing if this is required, and the housings may readily be configured so as to fit in place of known key operated switches offering the same functions. If desired, only the key identification function need be performed by reed switches, and the common function could be controlled by suitably configured portions of the key operating a suitable lock mechanism mechanically. Instead of the key incorporating inserted magnets, it could incorporate integral magnetized zones.

As will be apparent to persons skilled in the art, various modifications, adaptations and variations of the foregoing specific disclosure can be made without departing from the teachings of the present invention.

We claim:

1. In a multiple-key switching system having a plurality of different keys, each having a different key body structure, for a plurality of different authorized users respectively, a keyway housing with a keyway for receiving the key body structures of the plurality of keys one at a time, and a plurality of separate switches mounted in association with the keyway housing, each of the key body structures being operable within the keyway for operating different combinations of switches respectively, the improvement wherein the keyway housing is generally tubular, wherein said switches are magnetically operable switches and are mounted in a generally annular arrangement about the tubular housing keyway, and wherein the different key body structures of the plurality of different keys have different generally annular arrangements of magnetic elements respectively for magnetic association with the respective combinations of switches respectively whereby each of the key body structures is operable within the keyway for magnetic operation of the respective switches.

2. In a multiple-key switching system according to claim 1 wherein the switches are hermetrically sealed reed switches.

3. In a multiple-key switching system according to claim 1 wherein the tubular keyway housing has a plurality of angularly spaced switch supports about the keyway for selectively receiving and locating switches therein.

4. In a multiple-key switching system according to claim 3 wherein the switch supports extend generally axially.

5. In a multiple-key switching system according to claim 4 wherein the annular arrangement of switches comprises a plurality of axially spaced banks of switches mounted within the generally axially extending switch supports.

6. In a multiple-key switching system according to claim 1 wherein at least one of the magnetically operated switches is a normally closed switch.

7. In a multiple-key switching system according to claim 1 wherein the annular arrangement of switches comprises at least two axially spaced banks of switches.

8. In a multiple-key switching system according to claim 1 wherein each key body structure comprises a magnet housing with an annular arrangement of a plurality of angularly spaced supports, and at least one magnet mounted on one of said supports.

9. In a multiple-key switching system according to claim 8 wherein each key body structure further comprises magnet screening rods mounted on the supports on both angular sides of each magnet.

* * * * *